US008701244B2

(12) United States Patent
Hyun et al.

(10) Patent No.: US 8,701,244 B2
(45) Date of Patent: Apr. 22, 2014

(54) VACUUM CLEANER

(75) Inventors: Kietak Hyun, Seoul (KR); Geunbae Hwang, Seoul (KR); Jaedal Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 212 days.

(21) Appl. No.: 13/301,985

(22) Filed: Nov. 22, 2011

(65) Prior Publication Data

US 2012/0159737 A1 Jun. 28, 2012

(30) Foreign Application Priority Data

Dec. 28, 2010 (KR) ..... 10-2010-0136277

(51) Int. Cl.
*A47L 9/10* (2006.01)

(52) U.S. Cl.
USPC ..... 15/352; 15/353; 55/428; 55/429; 55/459.1; 55/DIG. 3

(58) Field of Classification Search
USPC ..... 15/352, 353; 55/428, 429, 459.1, DIG. 3
IPC ..... A47L 9/10
See application file for complete search history.

(56) References Cited

U.S. PATENT DOCUMENTS

| | | | | |
|---|---|---|---|---|
| 7,600,293 | B2 * | 10/2009 | Lee et al. | 15/352 |
| 2006/0010641 | A1 * | 1/2006 | Nam et al. | 15/352 |
| 2010/0229332 | A1 | 9/2010 | Kang | 15/347 |

FOREIGN PATENT DOCUMENTS

| | | | |
|---|---|---|---|
| EP | 1 987 757 | A2 | 11/2008 |
| EP | 1 987 758 | A2 | 11/2008 |
| FR | 2 823 091 | A1 | 10/2002 |
| JP | S60-185529 | A | 9/1985 |
| JP | H07-313412 | A | 12/1995 |

OTHER PUBLICATIONS

European Search Report dated Oct. 2, 2013 issued in Application No. 11 01 0006.

* cited by examiner

*Primary Examiner* — David Redding
(74) *Attorney, Agent, or Firm* — Ked & Associates, LLP

(57) ABSTRACT

A vacuum cleaner is disclosed. The vacuum cleaner includes a body having a vacuum motor provided therein; a dust collection device provided in the body to collect dust; a dust compression device expandable or contractible selectively; a passage switching device configured to selectively communicate the dust compression device with a low pressure part having a lower pressure than a pressure of the dust collection device and a high pressure part having a higher pressure than a pressure of the dust collection device.

20 Claims, 7 Drawing Sheets

(a)

(b)

(a)

(b)

VACUUM CLEANER

CROSS-REFERENCE TO RELATED APPLICATION

This application claims priority under 35 U.S.C. §119 from Korean Application No. 10-2010-0136277 filed on Dec. 28, 2010, the subject matter of which is incorporated herein by reference.

BACKGROUND

1. Field

Embodiments may relate to a vacuum cleaner, more particularly, to a vacuum cleaner which is able to compress dusts sucked therein only to enhance user convenience.

2. Background

Generally, a vacuum cleaner is an electric appliance that filters dust, dirt and foreign matters together with air into a body provided therein, after sucking them by using a vacuum motor mounted in the body.

Such a vacuum cleaner may be classified into a canister type having a suction nozzle in communication with the body via a connection pipe and an upright type having a suction nozzle integrally formed with the body as suction inlet.

The canister type vacuum cleaner out of the two types may include a vacuum cleaner body having a vacuum motor configured to generate a suction force mounted therein, a suction nozzle configured to suck dust and foreign matters scattered on a surface to vacuum-clean by the suction force generated in the body, and a connection pipe configured to connect the body and the suction nozzle with each other.

In other words, once an electric power is applied to the body, the vacuum motor may be driven and the suction force may be generated. The suction force enables the suction nozzle to suck therein the air containing dust and foreign matters scattered on the surface which will be cleaned.

The air containing the dust and foreign matters may be drawn into the body via the connection pipe.

The dust and foreign matters contained in the air sucked into the body may be separated within a dust separation device provided in the body by cyclone theory.

After that, the separated dust and foreign matters may be collected in a dust collection device in communication with the dust separation device and the air having the dust and foreign matters separated there from may be exhausted outside the body.

In the meanwhile, if the dust and foreign matters separated by the dust separation device are accumulating in the dust collection device, a user may detach the dust collection device from the body to throw away the dust and foreign matters.

However, the accumulating dust and foreign matters might be scattered within the dust collection device because of a light weight and they might be scattered when the user throws them away after separating the dust collection device from the body.

SUMMARY

Accordingly, the embodiments may be directed to a vacuum cleaner. To solve the problems, an object of the embodiments may be to provide a vacuum cleaner which includes a dust compression device to compress foreign matters collected in a dust collection device provided therein.

Another object of the embodiments may be to provide a vacuum cleaner which can compress the foreign matters collected in the dust collection device by using a difference between a pressure inside a vacuum motor and a pressure inside the dust compression device and a difference between a pressure of external air and a pressure inside the dust compression device.

A further object of the embodiments may be to provide a vacuum cleaner which includes a passage switching device to make the inside of the dust compression device in communication with the vacuum motor or external air selectively.

To achieve these objects and other advantages and in accordance with the purpose of the embodiments, as embodied and broadly described herein, a vacuum cleaner includes a body having a vacuum motor provided therein; a dust collection device provided in the body to collect dust; a dust compression device expandable or contractible selectively, to compress the dust collected in the dust collection device; a passage switching device configured to selectively communicate the dust compression device with a low pressure part having a lower pressure than a pressure of the dust collection device and a high pressure part having a higher pressure than a pressure of the dust collection device, wherein the passage switching device includes a chamber comprising a compression part passage in communication with the dust compression device; a low pressure part passage provided in the chamber, in communication with the low pressure part; a high pressure part passage provided in the chamber, in communication with the high pressure part; and a rotational member rotatably provided in the chamber, to communicate the compression part passage with either of the low pressure part passage and the high pressure part passage.

According to the embodiment, there may be an effect of providing a vacuum cleaner including a dust compression device configured to compress foreign matters stored in a dust collection device.

Furthermore, there may be another effect of providing a vacuum cleaner which can compress the foreign matters collected in the dust collection device by using a difference between a pressure inside a vacuum motor and a pressure inside the dust compression device and a difference between a pressure of external air and a pressure inside the dust compression device.

A still further, there may be a further effect of providing a vacuum cleaner including a passage switching device to make the inside of the dust compression device in communication with a vacuum motor or external air selectively It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

As follows, exemplary embodiments will be described in detail in reference to the accompanying drawings.

Reference may now be made in detail to specific embodiments, examples of which may be illustrated in the accompanying drawings. Wherever possible, same reference numbers may be used throughout the drawings to refer to the same or like parts.

Figure 1:
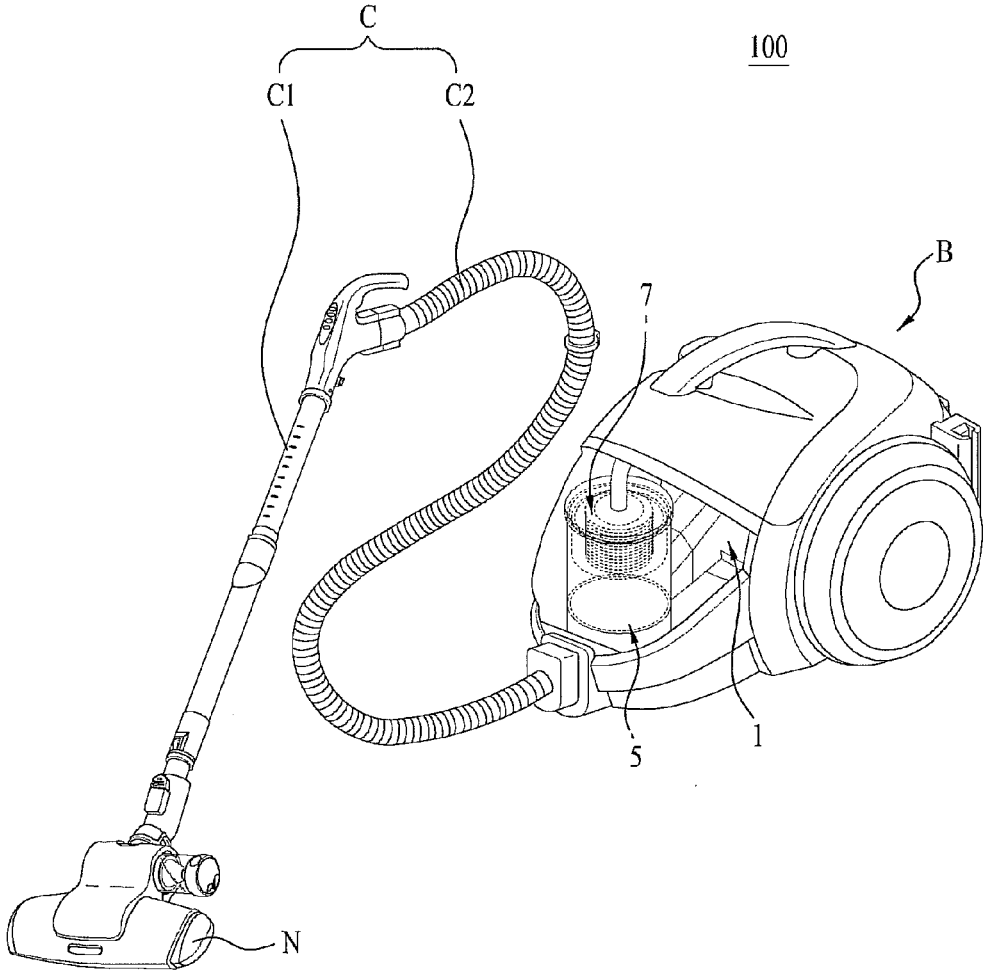
FIG. 1 is a perspective view illustrating a vacuum cleaner according to an embodiment.

A vacuum cleaner 100 shown in FIG. 1 may include a body (B) configured to generate a suction force by using a vacuum motor and a connection part (C) configured to transmit the suction force generated in the body (B) to a suction nozzle (N) to guide suction of dust and air.

In the meanwhile, the suction nozzle (N) connected to an end of the connection part may suck dust and foreign matters scattered on a surface to vacuum-clean together with air.

The connection part (C) may include an extendible pipe (C1) and a connection hose (C2). An end of the extendible pipe (C1) may be connected with the suction nozzle (N) and the other end may be connected with the connection hose (C2), to make the suction nozzle (N) in communication with the body (B).

In this body, the extendible pipe (C1) may be able to be extended for user convenience.

In the meanwhile, the suction nozzle (N) connected with the extendible pipe (C1) may be movable forward/rearward and rightward/leftward with respect to the surface to vacuum-clean during the cleaning. Because of that, the connection hose (C2) may be formed of a flexible member for the user to perform cleaning smoothly.

The vacuum motor (11, see FIG. 2) may be provided in the body (B). When the vacuum motor 11 is driven, the suction force may be generated and the suction force of the vacuum motor may be transported to the suction nozzle (N) via the connection part (C).

As a result, dust and foreign matters existing on the surface to vacuum-clean may be sucked into the body (B) and the sucked foreign matters may be collected in a dust collection device provided in the body (B), which will be described in detail later.

Figure 2:
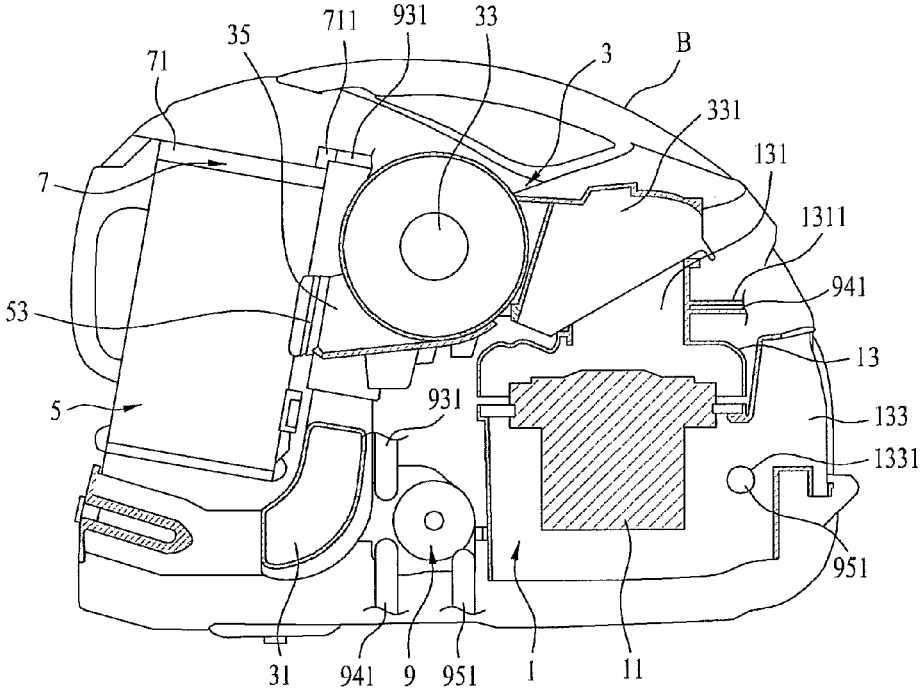
FIG. 2 is a diagram illustrating a body provided in the vacuum cleaner.

FIG. 2 illustrates an internal structure of the body composing the vacuum cleaner according to the embodiment. In the body (B) may be provided a suction unit 1 configured to generate the suction force, a dust separated device 3 in communication with the suction unit 1 and a dust collection device 5 in communication with the dust separation device 3.

The suction unit 1 may include a motor housing 13 and the vacuum motor 11 arranged in the motor housing.

The motor housing 13 may be in communication with the dust separation device 3 via an inlet part 131 and a filter device 331 and air sucked by the vacuum motor may be exhausted outside the body via an outlet part 133.

The dust separation device 3 may be in communication with the vacuum motor 11, the connection part (C) and the dust collection device 5. The foreign matters scattered on the surface to vacuum-clean may be sucked into the dust separation device, in a status of being mixed with air, and the dust separation device 3 may separate dust from air by using a centrifugal force according to a dust separation function.

After that, the foreign matters such as dust may be moved to the dust collection device 5 and the air separated from the dust and foreign matters may be moved to the vacuum motor 11.

The dust separation device 3 may include a suction pipe 31 connected with the connection hose (C1), an air outlet 33 configured to exhaust the air out of the mixture of the air and foreign matters sucked via the suction pipe 31, and a dust outlet 35 connected with the dust collection device 5 to move the foreign matters separated from the air to the dust collection device 5.

The structure of the dust separation device 3 shown in FIG. 2 may be a dust separation structure using a cyclone theory. Any dust separation structures capable of separating foreign matters and air from mixture of air and foreign matters sucked outside the body may be applicable to the dust separation device 3.

Figure 3:
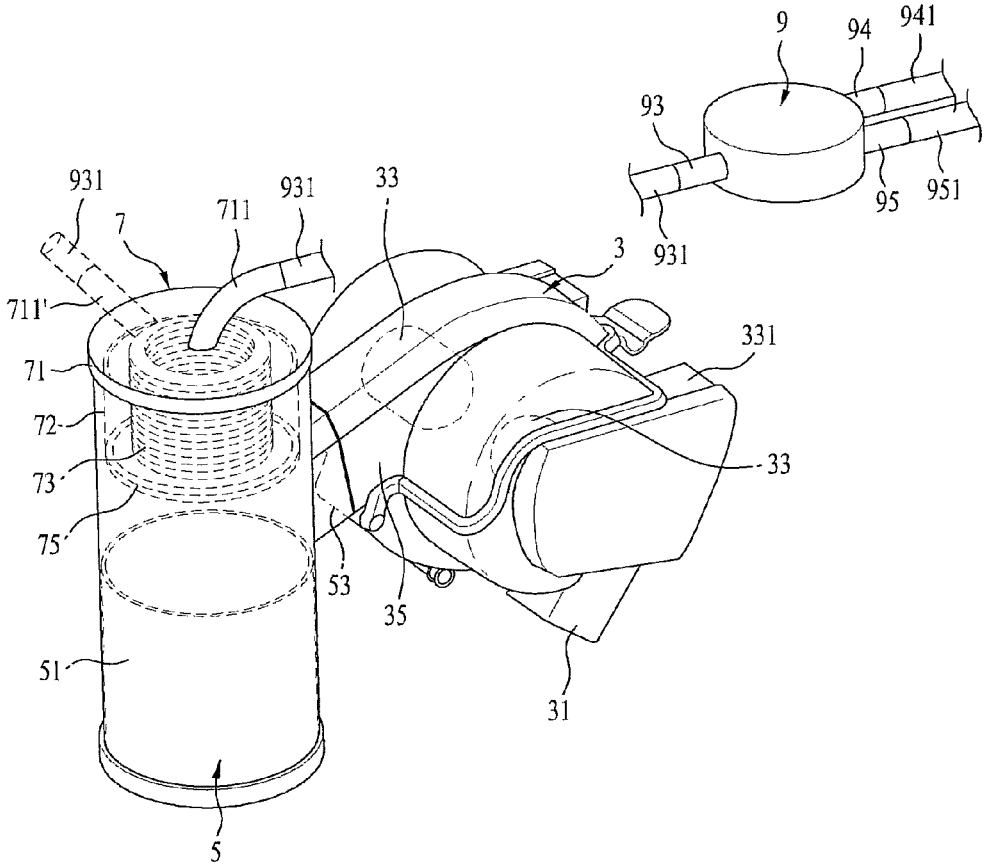
FIG. 3 is a perspective view illustrating a connection status among a dust separation device, a dust compression device and a dust collection device that are provided in the vacuum cleaner.

According to a structure of the dust collection device shown in FIG. 3, the dust collection device 5 may include a dust collection chamber 51 configured to store the foreign matters drawn from the dust separation device 3 and a dust inlet 53 configured to make the dust collection chamber 51 communicate with the dust outlet 35.

In the meanwhile, a dust compression device 7 may be provided in the dust collection device 5 to reduce a volume of the collected foreign matters by compressing the dust collected in the dust collection chamber 51.

The dust compression device 7 may be driven by a passage switching device 9 which will be described later.

As follows, the connection among the dust separation device 3, the dust collection device 5, the dust compression device 7 and the passage switching device 9.

The dust compression device 7 may compress the foreign matters collected in the dust collection chamber to an end of the dust collection chamber 51, in communication with the dust collection chamber 51 of the dust collection device 5.

FIG. 3 illustrates the dust compression device 7 provided in a top end of the dust collection chamber 51. The dust compression device 7 may be demountable from the dust collection device 5 by a mounting/demounting device 71.

A case 72 having an open bottom may be provided in a bottom of the mounting/demounting device 71. The case 72 may be cylindrical shape.

A piston 73 may be provided in the case 72. The piston 73 may be expandable or contractible within the dust collection chamber 51 according to an air pressure provided from a guide pipe 931 which will be described later, or it may reciprocate within the dust collection chamber 51.

In the meanwhile, a compression part passage connection part 711 connected with the guide pipe 931 may be provided in an upper end of the mounting/demounting device 71 and the compression part passage connection part 711 may be in communication with the piston 73, passing through the mounding/demounting device 71.

Here, the position of the compression part passage connection part 711 may be one of examples and the compression part passage connection part 711 may be located at any positions in the dust compression device 7 only if it enables the guide pipe 931 to be in communication with the piston 73 (see 711*a*).

The piston 73 may have an expandable and contractible structure only if it is able to be extendible according to the air pressure provided from the guide pipe 931. The piston 73 may be bellows, telescopic cylinder and air bag structures.

A press plate 75 may be provided in an end of the piston 73 to close the open bottom of the case 72 when the piston is contacted.

In this case, the press plate 75 may have a predetermined appearance corresponding to a cross section of the dust collection device 51. FIG. 3 illustrates a disc-shaped press plate 75 provided in the cylindrical dust collection chamber 51.

The passage switching device 9 may enable the dust compression device 7 to selectively communicate with either of a low pressure part having a lower pressure than a pressure inside the dust compression device 7 or with a high pressure part having a higher pressure than the pressure inside the dust compression device 7.

The low pressure part may be any element of the vacuum cleaner only if they have a lower pressure than the pressure inside the dust compression device and the high pressure part may be any element only if they have a higher pressure than the pressure inside the dust compression device.

As follows, the low pressure part may be configured to be the inlet part of the vacuum motor (11, see FIG. 2) and the high pressure part may be an outer surface of the body or the outlet part of the vacuum motor 11, for explanation convenience.

The passage switching device 9 may be configured to enable the dust compression device 7 to communicate with an inlet part of the vacuum motor 11 or external air of the body (an outlet part of the vacuum motor 11) selectively. When the dust compression device 7 is in communication with the inlet of the vacuum motor 11, the piston 73 may be contracted.

However, when the dust compression device 7 is in communication with the external air of the body (the outlet part of the vacuum motor 11), the piston 73 may be growing or expanded only to compress the foreign matters collected in the dust collection chamber.

The passage switching device 9 may include a first connection port 93 connected with the compression part passage connection part 711 of the dust compression device 7 via the guide pipe 931, a low pressure part connection port 94 in communication with the inlet of the vacuum motor 11 and a high pressure part connection port 95 in communication with external air of the body (the outlet of the vacuum motor 11).

The low pressure part connection port 94 may be connected with a low pressure part passage connection pipe 1311 provided in the inlet part 131 via the lower pressure part connection pipe 941 and the high pressure part connection port 95 may be connected with a high pressure part passage connection pipe 1331 provided in the outlet part 133 via the high pressure part connection port 95 (see FIG. 2).

In the embodiment, among the dust collection chamber 51, the inlet part 131 of the motor housing 13 and the outlet part 133 of the motor housing 13, the inlet part 131 has the lowest pressure. Meanwhile, Among them, the outlet part 133 has the highest pressure. Here, an internal space of the dust collection chamber may have an intermediate value between the pressure of the inlet part 131 and the pressure of the outlet part 133.

As a result, when the passage switching device 9 communicates the piston 73 of the dust compression device 7 with the inlet part 131 (the low pressure part), the internal space of the dust collection chamber 51 may have a higher pressure than the pressure of the inlet part 131 and the piston 73 may be contracted.

However, when the passage switching device 9 communicates the piston of the dust compression device 7 with the outlet part 133, the pressure possessed by the external air of the body may be higher than the pressure possessed by the internal space of the dust compression device and the piston 73 may compress the foreign matters collected in the dust collection chamber 51 (that is, the growing of the piston).

As follows, the process of collecting and compressing the foreign matters will be described in brief in reference to FIGS. 2 and 3.

In reference to FIG. 2, the dust separation deice 3 may be connected with the inlet part 131 of the vacuum motor 11 via the filter device 331 and with the dust inlet 53 of the dust collection chamber 51 via the dust outlet 35.

As a result, when the vacuum motor 11 is driven, the suction force of the vacuum motor 11 may be transmitted to the dust separation device 3 via the inlet part 131, the filter device 331 and the air outlet 33 in communication with the filter device 331.

The suction force transmitted to the dust separation device may be transmitted to the connection hose (C2), the extendible pipe (C1) and the suction nozzle (N) via the suction pipe 31. Because of that, the foreign matters scattered on the surface to vacuum-clean in a state of mixed with air may be drawn into the dust separation device 3 via the suction pipe 31.

The air drawn via the suction pipe 31 may contain foreign matters and the air outlet 33 may exhaust only air to the motor housing 13 via the filter device 331 and the inlet part 131. The air drawn into the motor housing 13 may be exhausted outside the body (B) via the outlet part 133.

In the meanwhile, the foreign matters separated from the air within the dust separation device 3 may be moved to the dust collection chamber 51 via the dust outlet 35 and the dust inlet 53.

In reference to FIG. 3, the foreign matters drawn into the dust collection chamber 51 may be compressed by the piston 73 of the dust compression device 7.

In other words, the passage switching device 9 may communicate external air of the body (the high pressure part) with the piston 73. When the piston is growing after that, the press plate 75 may press the foreign matters collected in the dust collection chamber.

However, when the passage switching device 9 communicates the piston 73 with the inlet part (the low pressure part) 131, the piston 73 may contracted to be located in the case 72.

As a result, the vacuum cleaner according to the embodiment may have an effect of enabling compression storage of foreign matters within the dust collection chamber.

Figure 4:
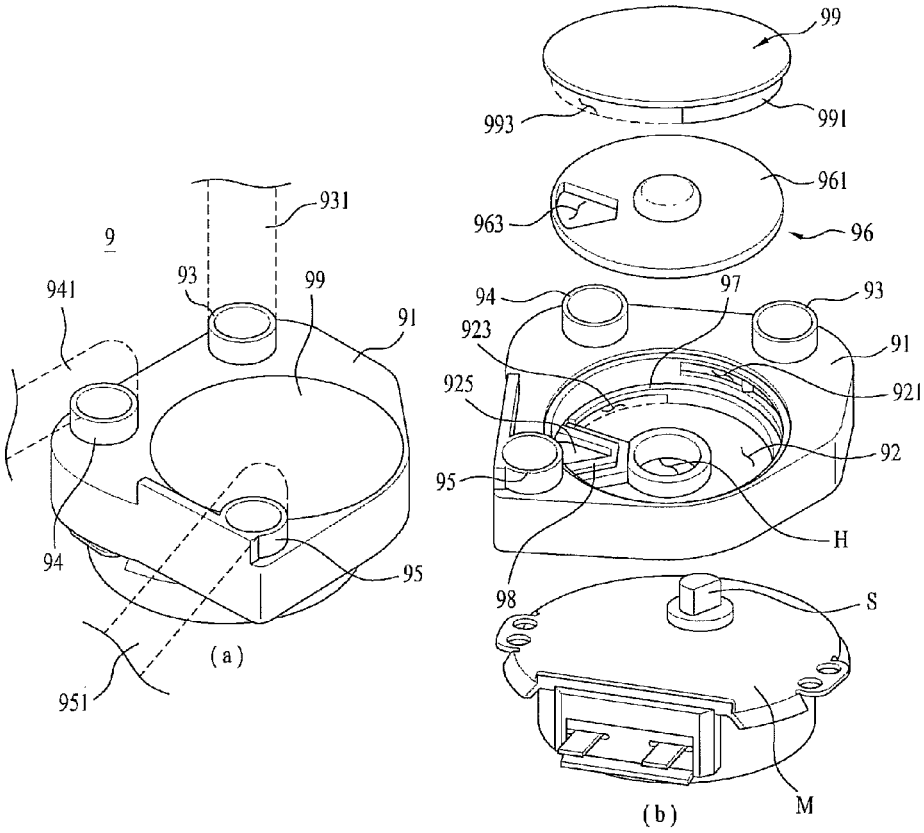
FIG. 4 includes a perspective view and an exploded perspective view illustrating a passage switching device provided in the vacuum cleaner.
Figure 6:
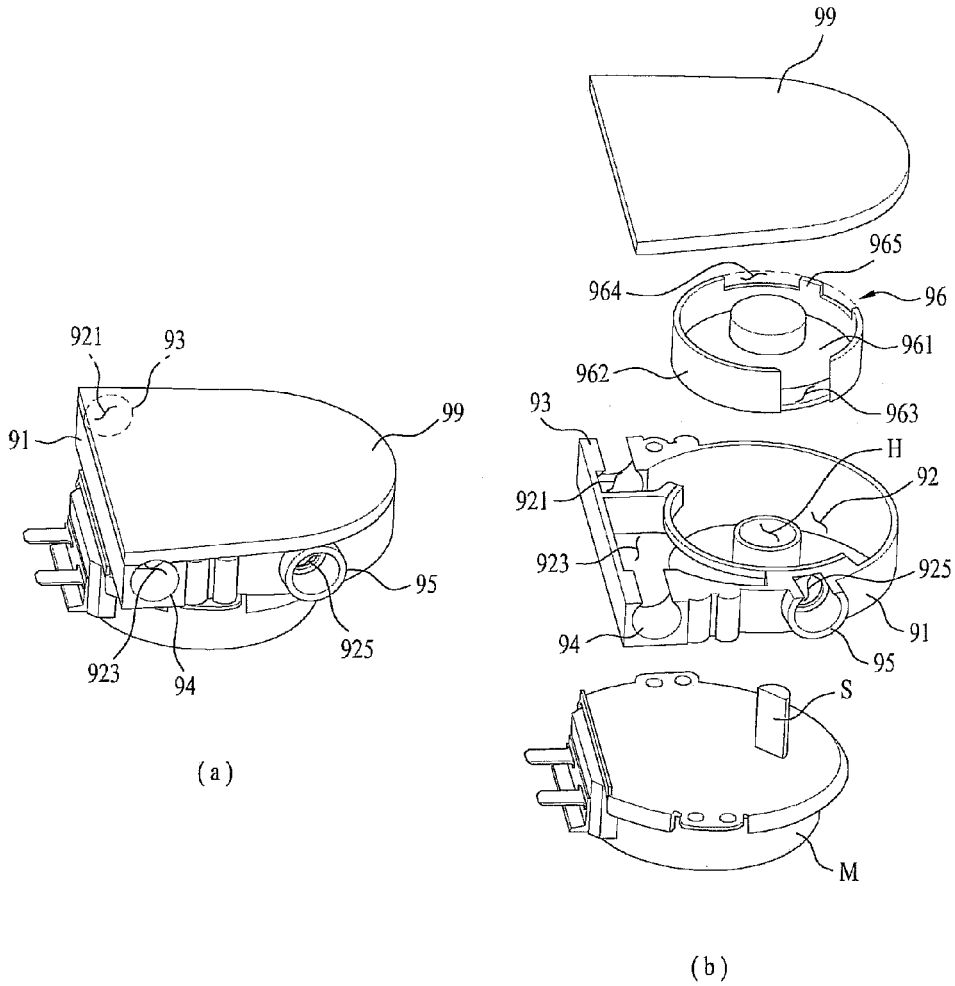
FIG. 6 includes a perspective view and an exploded perspective view illustrating a passage switching device according to another embodiment.

FIG. 4 illustrates a passage switching device according to an embodiment provided in the vacuum cleaner and FIG. 6 illustrates a passage switching device according to another embodiment. As follows, a detailed structure of the passage switching device provided in the vacuum cleaner will be described.

First of all, a structure of a passage switching device disclosed in FIG. 4 will be described. as shown in FIG. 4(*a*), the passage switching device 9 may include a housing 91 configured to define an exterior appearance thereof, a compression part connection port 93 provided in the housing g 91, in communication with the dust compression device 7, a low pressure part connection port 94 connected with the low pressure part, and a high pressure part connection port 95 connected with the high pressure part.

The compression part connection port 93 may be connected with the compression part connection pipe 931 and the low pressure part connection port 94 may be connected with the low pressure part connection pipe 941. The high pressure part connection port 95 may be connected with the high pressure part connection pipe 951.

According to an internal structure of the passage switching device 9 in reference to FIG. 4(*b*), a chamber 92 may be provided in the housing 91 to provide a proper space.

Also, the passage switching device 9 may include a compression part passage 921 configured to communicate the chamber 92 with the compression part connection port 93, a low pressure part passage 923 configured to communicate the chamber with the low pressure part connection port 94, and a high pressure part connection passage 925 configured to communicate the chamber 92 with the high pressure part connection port 95.

A rotational member 96 coupled to a shaft (S) of a motor (M) provided outside the chamber may be further provided in the chamber 92 to open the low pressure part passage and the high pressure part passage selectively.

In this case, a shaft passing hole (H) may be provided in a bottom surface of the chamber 92 to have the shaft of the motor (M) to pass there through.

The rotational member 96 shown in FIG. 4(*b*) may be a rotational plate 961 coupled to the shaft (S) of the motor, with partitioning the internal space of the chamber into an upper space and a lower space.

In this case, a hole-shaped passage opening part 963 passing through the rotational plate may be provided in the rotational plate 961 to communicate the upper and lower spaces of the chamber with each other. The compression part passage 921 may be located in the upper space of the chamber and the low pressure part passage 923 and the high pressure part passage 925 may be located in the lower space of the chamber 92.

A gap between the low pressure part passage 923 and the high pressure part passage 925 may be larger than the passage opening part 963. This is because either of the low pressure part and high pressure part passages 923 and 925 has to communicate with the compression part passage selectively.

Here, a partitioning part 98 extended from the high pressure part passage 925 to contact with a lower surface of the rotational plate 961 may be further provided in the chamber 92.

The partitioning part 98 may be a rib or wall that is arranged to cover the high pressure part passage 925 and the space in communication with the high pressure part passage 925.

The partitioning part 98 may be employed to partition off the high pressure part passage 925 and the space in communication with the high pressure part passage 925 from the low pressure part passage 923 and the space in communication with the low pressure part passage 923.

The partitioning part 98 may be in contact with the lower surface of the rotational plate 961. Because of that, it may be prevented that the air inside the high pressure part passage 925 and the space in communication with the high pressure part passage 925 is mixed with the air inside the low pressure part passage 923 and the space in communication with the low pressure part passage 923.

An area of the space covered by the partitioning part 98 may be identical to an area of the passage opening part 963 or larger than an area of the passage opening part. FIG. 4(*b*) illustrates the partitioning part 98 formed in a shape corresponding to a shape of the passage opening part 963.

As a result, when the motor (M) is driven by a control unit (not shown), the rotational plate 961 is rotated and the passage opening part 963 provided in the rotational plate 961 may open or close the space inside the partitioning part 98 connected with the high pressure part passage 925 based on a rotation angle of the rotational plate 961.

In other words, when the passage opening part 963 of the rotational plate 961 is located above the low pressure part passage 923, the partitioning part 98 may contact with the lower surface of the rotational plate 961 and the high pressure part passage 925 may be closed.

In this case, the low pressure part passage 923 may be in communication with the passage opening part 963 and the low pressure part passage 923 may be then in communication with the compression part passage 921.

However, when the passage opening part 963 of the rotational plate is located above the space surrounded by the partitioning part 98, the low pressure part passage 923 may be closed by the rotational plate and the high pressure part passage 925 may be in communication with the compression part passage 921 provided in the upper space of the chamber.

When the space surrounded by the partitioning part 98 is closed by the rotational plate 961, the low pressure part passage 923 may be in communication with the low pressure part passage connection pipe 1311 via the low pressure part connection port 94 and the lower pressure part connection pipe 941. Because of that, the compression part passage 921 provided in the upper space of the chamber 92 may be in communication with the vacuum motor 11.

In the meanwhile, when the space surrounded by the partitioning part 98 is opened by the rotational plate 961 (in other words, when the passage opening part 963 is located above the partitioning part 98), the high pressure part passage 925 may be in communication with the high pressure part via the high pressure part connection port 95, the high pressure part connection pipe 951 and the high pressure part passage connection pipe (1331, see FIG. 2).

As a result, the compression part passage 921 provided in the upper space of the chamber 92 may be in communication with the high pressure part.

FIG. 4(*b*) only illustrates the partitioning part 98 extended from the high pressure part passage 925. The partitioning part 98 may be provided in only the low pressure part passage 923 or it may be provided in each of the high pressure part passage 925 and the low pressure part passage, only if the rotational plate is able to communicate the compression part passage 921 with the low pressure part passage 923 and the high pressure part passage 925.

Here, if the rotation speed of the rotational plate 961 is uniform in case that the partitioning part 98 is extended from the high pressure part passage 925, the communication time between the high pressure part passage 925 and the compression part passage 921 may be shorter than the communication time between the low pressure part passage 923 and the compression part passage 921. This may generate a following effect.

When the piston 73 is in communication with the high pressure part passage 925 for a short time period, the piston 73 may be growing quickly. Here, the press plate 75 connected with the piston 73 may compress the dust or foreign matters collected in the dust collection chamber, while applying a shock to the dust or foreign matters. Because of that, the foreign matters may be compressed more smoothly and efficiently.

A first guide member 97 may be provided in the chamber 92 to guide the rotation of the rotational member 96, with supporting the rotational member 96. A cover 99 may be further provided on the rotational member 96 to cover the rotational member 96, with closing the chamber 92 airtight.

The first guide member 97 may be a step projected from a proper area of an inner circumferential surface of chamber 92 toward a center of the chamber 92.

In this case, a proper area of an outer circumferential surface of the rotational plate 961 may be supported by the first guide member 97.

The cover 99 may be detachably provided on a top surface of the chamber 92 and it may close the chamber 92 and the rotational member 96 airtight.

In the meanwhile, a second guide member 991 may be provided under the cover 99 to support the top surface of the rotational plate 961 and to guide the rotation of the rotational plate 961 with respect to the cover 99.

The second guide member 991 may be employed to prevent the rotational plate 961 from being separated from the first guide member 97 during the driving of the motor (M).

As a result, the second guide member 991 may be provided in contact with the top surface of the rotational plate 961. If it is concerned that the second guide member 991 interferes with the rotation of the rotational plate 961, the second guide member 991 may be spaced apart a proper distance from the top surface of the rotational plate 961.

In the meanwhile, even if the second guide member 991 is extended downwardly from the cover 99 to support the top surface of the rotational plate 961, the compression part passage 921 provided in the chamber 92 should not be closed by the second guide member 991.

In other words, if the second guide member 991 is provided along a lower circumferential surface of the cover, a passage communication recess 993 may be provided as shown in FIG. 4(*b*) such that the compression part passage 921 may not be closed by the second guide member 991.

The second guide member 991 may be partially cut away to form the passage communication recess 993 and the passage communication recess 993 may be arranged at a proper position corresponding to the position of the compression part passage 921.

The arrangement may enable the compression part passage 921 to communicate with the passage opening part 963.

As follows, an operation process of the passage switching device 9 having the configuration described above will be described in reference to FIG. 5.

Figure 5:
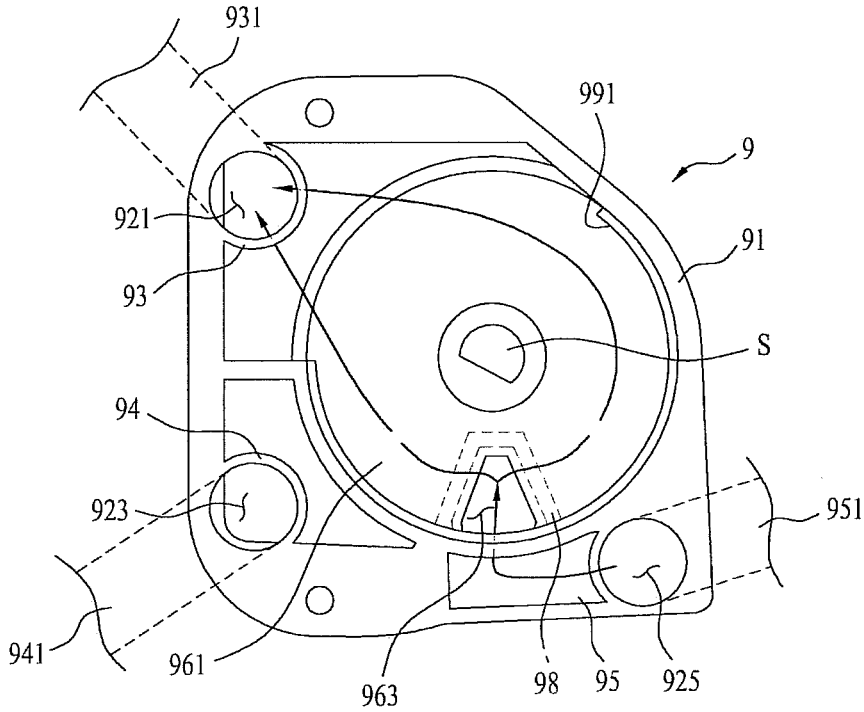
FIG. 5 is a diagram illustrating an operation process of the passage switching device provided in the vacuum cleaner.
Figure 5:
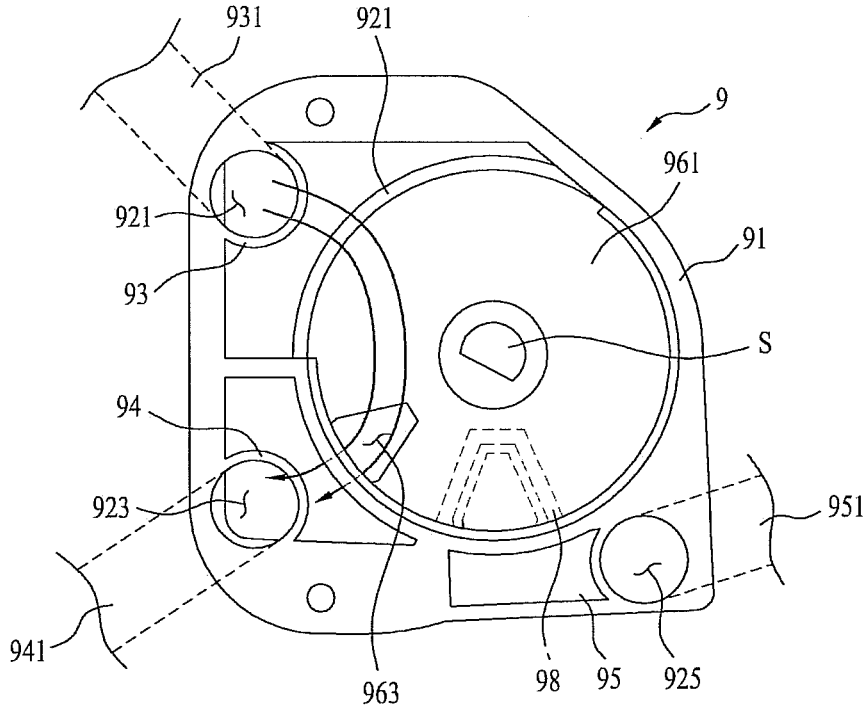

FIG. 5(*a*) illustrates that the passage switching device 9 communicates the dust compression device 7 with the high pressure part to enable the piston (73, see FIG. 3) to compress the foreign matters collected in the dust collection chamber 51.

FIG. 5(*b*) illustrates that the passage switching device 9 communicates the dust compression device 7 with the low pressure part to contract the piston 73 that is grew to compress the foreign matters collected in the dust collection chamber 51.

First of all, it will be described the case of the piston 73 compressing the foreign matters collected in the dust collection chamber 51. The control unit (not shown) may rotate the shaft (S) of the motor (M) to enable the passage opening part 963 of the rotational plate 961 to open the space surrounded by the partitioning part 98.

In this case, the low pressure part passage 923 in communication with the inner circumferential surface of the chamber 92 and the space in communication with the low pressure part passage 923 may be closed by the lower surface of the rotational plate 961 and the partitioning part 98. Because of that, the compression part passage 921 may be in communication with the high pressure part passage 925.

The high pressure part passage 925 may be in communication with the outlet part 133 or the outside of the body 1 via the high pressure part connection port 95 and the high pressure part connection pipe 951. The compression part passage 921 may be in communication with the piston 73 of the dust compression device 7 via the compression part connection port 93 and the guide pipe 931.

In this case, the pressure possessed by the internal space of the dust collection chamber 51 having the piston 73 provided therein may be lower than the pressure possessed by the atmosphere.

As a result, when the compression part passage 921 is in communication with the high pressure part passage 925, external air of the body (the atmosphere) or air of the outlet part 133 may be supplied to the piston 73 and the piston 73 may be growing within the dust collection chamber 51.

When the piston 73 is growing, the press plate 75 provided in the end of the piston 73 may move toward the foreign matters collected in the dust collection chamber 51 toward the end of the dust collection chamber 51. Because of that, the foreign matters collected in the dust collection chamber 51 may be compressed.

In the meanwhile, when the control unit (not shown) may control the motor (M) to rotate the passage opening part 963 toward the low pressure part passage 923 (see FIG. 5(*b*)), the high pressure part passage 925 may be closed by the lower surface of the rotational plate 961 and the compression part passage 921 may be then in communication with the low pressure part passage 923.

The compression part passage 921 may be in communication with the piston 73 of the dust compression device 7 via the compression part connection port 93 and the guide pipe 931. The low pressure part passage 923 may be in communication with the low pressure part passage connection pipe 1311 connected with the inlet part 131 of the motor housing 13, via the low pressure part connection port 94 and the low pressure part connection pipe 941.

The low pressure part passage connection pipe 1311 may be provided in the inlet part 131 of the motor housing 13 and the inlet part 131 may be the space where the air exhausted from the dust separation device 3 is sucked. Because of that, the pressure possessed by the inlet part 131 may be lower than the pressure possessed by the internal space of the dust collection chamber 51.

As a result, the air inside the piston 73 that expanded the piston 73 may move to the vacuum motor 11 via the inlet part 131 and the piston 73 may perform contraction.

FIG. 6 illustrates a passage switching device according to another embodiment that is provided in the vacuum cleaner described above. As follows, a structure possessed by a passage switching device 19 according to another embodiment will be described.

The passage switching device 19 according to this embodiment may include a housing 191 configured to define an exterior appearance thereof, a compression part connection port 193 provided in the housing 191, a low pressure part connection port 194 provided in the housing 191 and a high pressure part connection port 195 provided in the housing 191.

Here, the passage switching device 19 may include a chamber 192 configured to provide a proper space in the housing 191 as shown in FIG. 6(*b*).

The chamber 191 may be provided a compression part passage 1921 in communication with the compression part connection port 193, a low pressure part passage 1923 in communication with the low pressure part connection port 194 and a high pressure part passage 1925 in communication with the high pressure part connection port 195.

In this case, the housing 191 may further include a cover 199 provided on an upper end of the chamber 192 to close an internal space of the chamber 92 airtight.

The compression part passage 1921, the low pressure part passage 1923 and the high pressure part passage 1925, which are provided in an inner circumferential surface of the chamber 192, may be selectively opened and closed by a rotational member 196 rotatably provided in the chamber 192. The rotational member 196 may be coupled to a shaft (S) of a motor (M) provided outside the housing 191.

For that, a shaft passing hole (H) may be provided in a bottom surface of the chamber 192 to insertedly pass the shaft (S) of the motor (M) there through.

The rotational member 196 may include a rotational plate 1961 coupled to the shaft of the motor, a flange 1962 provided along an outer circumferential surface of the rotational plate 1961 and a passage opening part 1963 provided in the flange 1962.

The flange 1962 may be in contact with an inner circumferential surface of the chamber 192 provided in the housing 191. In case of a rotational plate provided in the cylindrical-shaped chamber 912 as shown in FIG. 6(*b*), the flange 1962 may be vertically extended from an outer circumferential surface of the rotational plate 1961.

In the passage switching device 19 shown in FIG. 6, the compression part passage 1921, the low pressure part passage 1923 and the high pressure part passage 1925 may have the same height with respect to the bottom surface of the chamber 192.

Also, the flange 1962 may be in contact with the inner circumferential surface of the chamber 192. Because of that, the passage opening part 1963 configured to open the low pressure part passage 1923 or the high pressure part passage 1925 selectively may be provided in the flange 1962.

In the meanwhile, a passage communication recess 1964 may be provided in the flange 1962 to maintain an opening status of the compression part passage 1921.

The passage communication recess 1964 may have various shapes only if it can maintain the open status of the compression part passage 1921 in the rotation of the rotational member 196. FIG. 6(*b*) illustrates the flange 1962 having an upper end partially stepped or bent to form a recess.

In this case, a guide member 1965 may be further provided in the passage communication recess 1964. The guide member 1965 may guide a relative rotation of the rotational member 196 with respect to the cover 199.

The guide member 1965 may be a projection extended from the passage communication recess 1964 toward the cover 199 and the guide member 1965 may be as high as the upper end of the flange 1962.

The rotational member 196 may be supported by a lower surface of the cover 199 via the upper end of the flange 1962 and the upper end of the guide member 1965. Because of that, the rotational member 196 may be prevented from being separated even when it is rotated by the motor (M).

As follows, an operation process of the passage switching device shown in FIG. 6 will be described in reference to FIG. 7.

Figure 7:
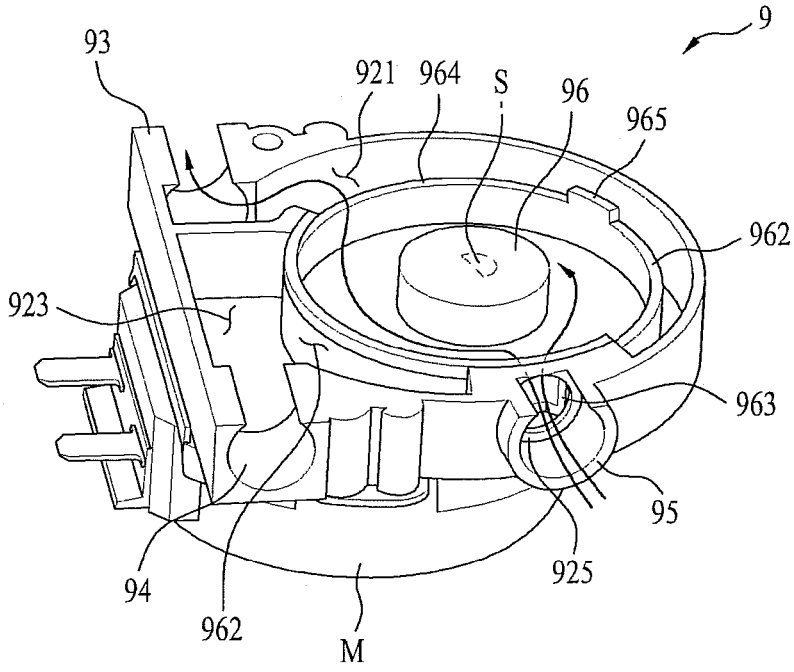
FIG. 7 is a diagram illustrating an operation process of the passage switching device shown in FIG. 6.
Figure 7:
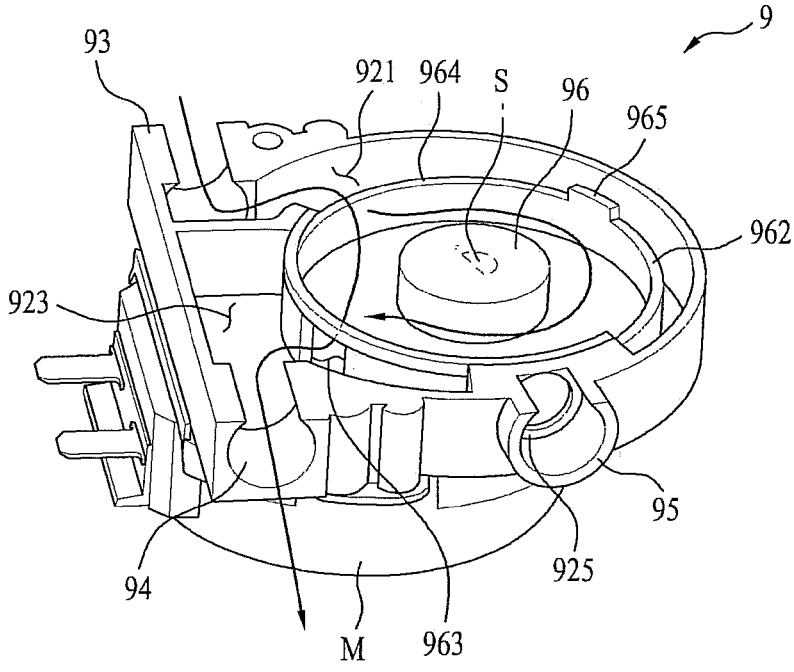

FIG. 7(*a*) illustrates that the passage switching device 19 communicates the dust compression device 7 with the atmosphere to enable the piston (73, see FIG. 3) to compress foreign matters collected in the dust collection chamber 51.

FIG. 7(*b*) illustrates that the passage switching device 19 communicates the dust compression device 7 with the vacuum motor 11 to contract the piston 73 having grown enough to compress the foreign matters collected in the dust collection chamber 51.

First of all, the case of the piston 73 compressing the foreign matters collected in the dust collection chamber 51 will be described. The control unit (not shown) may rotate the shaft (S) of the motor (M) and the passage opening part 1963 of the flange 1962 may open the high pressure part passage 1925.

In this case, the low pressure part passage 1923 in communication with the inner circumferential surface of the chamber 192 may be closed by the flange 1962 and the compression part passage 1921 may be then in communication with the high pressure part passage 1925.

The high pressure part passage 1925 may be in communication with the outlet part 133 via the high pressure part connection port 195 and the high pressure part connection pipe 1951. The compression part passage 1921 may be in communication with the piston 73 of the dust compression device 7 via the compression part connection port 193 and the guide pipe 1931.

In the meanwhile, the pressure possessed by the dust collection chamber 51 having the piston 73 provided therein may be lower than the pressure possessed by the atmosphere. Because of that, when the compression part passage 1921 is in communication with the high pressure part passage 1925, the air inside the high pressure part may be supplied to the piston 73 and the piston 73 may be expanded or growing within the dust collection chamber 51.

In this case, the press plate 75 provided in the end of the piston 73 may move the foreign matters collected in the dust collection chamber 51 toward a side of the dust collection chamber 51, only to compress the foreign matters collected in the dust collection chamber 51.

In the meanwhile, when the control unit (not shown) rotates the passage opening part 1963 toward the low pressure part passage 1923 by controlling the motor (M) (see FIG. 7(*b*)), the high pressure part passage 1925 may be closed by the flange 1962 and the compression part passage 1921 may be then in communication with the low pressure part passage 1923.

The compression part passage 1921 may be in communication with the piston 73 of the dust compression device 7 via the compression part connection port 193 and the guide pipe 1931. The low pressure part passage 1923 may be in communication with the low pressure part passage connection pipe 1311 connected with the inlet part 131, via the low pressure part connection port 194 and the low pressure part connection pipe 1941.

The low pressure part connection pipe (1311, see FIG. 2) may be provided in the inlet part 131 and the inlet part 131 may be the space where the air separated from the dust in the dust separation device 3 is drawn. The pressure possessed by the low pressure part passage connection pipe 1311 may be lower than the pressure possessed by the dust collection chamber 51.

As a result, when the compression part passage 1921 is in communication with the low pressure part passage 1923, the air supplied to the piston 73 to grow the piston 73 may move to the vacuum motor 11 via the suction part 131. Because of that, the piston 73 may be contracted.

In the mean while, the motor (M) may be controlled to enable the communication time between the high pressure part passage 1925 with the compression part passage 1921 to be shorter than the communication time between the low pressure part passage 1923 and the compression part passage 1921.

If the piston 73 is in communication with the high pressure part passage 1925 in a short time period, the piston 73 may be growing or expanded quickly. Here, the press plate connected with the piston 73 may compress the foreign matters collected in the dust collection chamber 51, with applying a shock to the foreign matters and the foreign matters may be compressed more smoothly and more efficiently, compared with a case of growing the piston 73 slowly.

Only if the partitioning part 98 of FIG. 4 is provided in the high pressure part passage 1925 in case that the rotational plate 1961 is rotated at a proper speed constantly by rotating the shaft of the motor at a proper speed constantly, the effect mentioned above may be realized.

However, if the rotation speed of the shaft of the motor is not maintained at a proper value, the control unit (not shown) may control the rotation speed of the rotational plate for the open time of the high pressure part passage to be shorter than the open time of the low pressure part passage and the effect mentioned above may be realized.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a body having a vacuum motor provided therein;

a dust collection device provided in the body to collect dust;

a dust compression device expandable or contractible selectively, to compress the dust collected in the dust collection device;

a passage switching device configured to selectively communicate the dust compression device with a low pressure part having a lower pressure than a pressure of the dust collection device and a high pressure part having a higher pressure than a pressure of the dust collection device, wherein the passage switching device comprises, a chamber comprising a compression part passage in communication with the dust compression device;

a low pressure part passage provided in the chamber, in communication with the low pressure part;

a high pressure part passage provided in the chamber, in communication with the high pressure part; and a rotational member rotatably provided in the chamber, to communicate the compression part passage with either of the low pressure part passage or the high pressure part passage.

2. The vacuum cleaner of claim 1, further comprising:

a passage opening part provided in the rotational member to guide flow of air by opening the low pressure part passage or the high pressure part passage to communicate the low pressure part passage or the high pressure part passage with the compression part passage.

3. The vacuum cleaner of claim 2, wherein the rotational member is a circular rotational plate to partition the chamber into upper and lower spaces, and the compression part passage is provided in the upper space of the chamber and the high pressure part passage and the low pressure part passage are provided in the lower space of the chamber.

4. The vacuum cleaner of claim 2, wherein an area of a space in the chamber in communication with the low pressure part passage is larger than an area of a space in the chamber in communication with the high pressure part passage.

5. The vacuum cleaner of claim 3, further comprising:

a partitioning part configured to surround the high pressure part passage and a space in communication with the high pressure part passage to partition them from the low pressure part passage and a space in communication with the low pressure part passage.

6. The vacuum cleaner of claim 5, wherein the partitioning part is in contact with the rotational plate, and an area of the space surrounded by the partitioning part is identical to or larger than an area of the passage opening part.

7. The vacuum cleaner of claim 2, further comprising:

a first guide member stepped in the chamber to support a lower surface of the rotational plate and to guide rotation of the rotational plate.

8. The vacuum cleaner of claim 2, further comprising:

a cover detachably provided in an upper end of the chamber to cover the chamber and the rotational member.

9. The vacuum cleaner of claim 8, wherein the cover comprises a second guide member extended from the cover downwardly to support a top surface of the rotational plate and to guide rotation of the rotational plate.

10. The vacuum cleaner of claim 9, further comprising:

a passage communication recess provided in the cover by cutting away the second guide member partially, wherein the passage communication recess is arranged in a position, corresponding to the compression part passage, to communicate the passage opening part with the compression part passage.

11. The vacuum cleaner of claim 1, wherein the rotational member comprises, a circular-shaped rotational plate;

a flange provided along an outer circumferential surface of the rotational plate to contact with an inner circumferential surface of the chamber, and the passage opening part is provided in the flange.

12. The vacuum cleaner of claim 11, further comprising:

a passage communication recess provided in the flange, with being separated from the passage opening part, to communicate with the compression part passage constantly.

13. The vacuum cleaner of claim 12, wherein the passage communication recess is stepped from a predetermined area of the flange.

14. The vacuum cleaner of claim 12, further comprising:

a cover detachably provided in an upper end of the chamber to cover the chamber and the rotational member.

15. The vacuum cleaner of claim 14, wherein an upper end of the flange is in contact with the cover.

16. The vacuum cleaner of claim 15, wherein the rotational member further comprises, a guide member provided in a side of the passage communication recess, in contact with the cover, to guide rotation of the rotational member with respect to the cover.

17. The vacuum cleaner of claim 1, wherein the low pressure part is an inlet of the vacuum motor or a space in communication with the inlet of the vacuum motor.

18. The vacuum cleaner of claim 1, wherein the high pressure part is an outlet of the vacuum motor or a space in communication with the outlet of the vacuum motor, or the outside of the body.

19. The vacuum cleaner of claim 1, further comprising:

a motor provided outside the chamber, with connected with the rotational member;

a control unit configured to control a rotational direction and a rotational speed of a shaft of the motor, wherein the control unit controls rotation of the rotational member, for the communication time between the compression part passage and the high pressure part passage to be shorter than the communication time between the low pressure part passage and the compression part passage.

20. The vacuum cleaner of claim 1, wherein the dust compression device is a piston or a multi-way pipe having the size that is changeable based on change of the pressure possessed by air therein.

* * * * *